US005584737A

United States Patent [19]

Luhtala

[11] Patent Number: 5,584,737

[45] Date of Patent: Dec. 17, 1996

[54] VERSATILE SAFETY DEVICE

[76] Inventor: Antti J. Luhtala, 718 S. Federal Hwy., Lake Worth, Fla. 33460

[21] Appl. No.: 283,563

[22] Filed: Aug. 1, 1994

[51] Int. Cl.[6] ..... B63C 9/08

[52] U.S. Cl. ..... 441/107; 2/2.5

[58] Field of Search ..... 441/88, 102–108, 441/112; 2/2, 2.5

[56] References Cited

U.S. PATENT DOCUMENTS

| | | | |
|---|---|---|---|
| 4,137,586 | 2/1979 | Evert | 441/107 |
| 4,416,641 | 11/1983 | Spinosa et al. | 441/107 |
| 4,864,656 | 9/1989 | Nesse | 441/106 |
| 5,060,314 | 10/1991 | Lewis | 441/112 |

*Primary Examiner*—Jesus D. Sotelo

[57] ABSTRACT

A versatile safety device can serve as a personal flotation device, a rain- or splash-water repellent flotation jacket, a flotation vest with full and constant buoyancy, a multitemperature jacket or vest, a breathing raincoat, and a bullet/fragment-proof safety device, and has an inflatable chamber insert and an optional anti-ballistic insert in the collar. To fulfill all these tasks the device with jacket frame, sleeves and collar, all of which incorporate buoyant material with thermal insulation properties, comprises zippers in the sleeves with water protectors, leg-straps, vacant margins in the areas on the construction seams, and anti-ballistic portions attachable to the device.

9 Claims, 6 Drawing Sheets

VERSATILE SAFETY DEVICE

FIELD OF THE INVENTION

This invention relates to personal safety devices and especially to such a versatile safety device which in addition of being a flotation device in case the wearer is immersed, can also be worn as regular garment in all kinds of weather conditions and if needed, can be easily converted in seconds to a bullet/fragment-proof device, is comfortable and flexible to wear.

DESCRIPTION OF THE PRIOR ART

Starting with common garments which have been designed to be versatile and comfortable, one has to be concerned with the following requirements, especially in regard to personal flotation devices: The device has to contain material which is lighter than water and which floats the person who falls in water and turns and holds him in upright position. Although most flotation devices do so, this characteristics can be improved. The statistics show that only a fraction of boaters wear flotation devices even though they have one available. The reason is that most such devices are not very comfortable nor flexible.

This situation has been improved in my Canadian Patent No. 1,111,714 which introduces a flotation device which is very flexible with its construction design. One wishes to wear it more than the traditional ones. The comfort and versatility can be improved, however.

In order for a flotation device to be a useful safety device in cold weather, it has to have sleeves. If the sleeves contain flotation material the device is not only warmer but has better floating ability. The best structure in the flotation filled sleeves is achieved by using the above mentioned Canadian Patent seam location which makes the sleeves flexible and gives the device ability to "breathe". If the weather is extremely hot, the sleeves are altogether too much. Therefore, some flotation devices have improved the situation by providing zippers around the armhole which enable the person to remove the sleeves completely. If this is done, the device loses some of its flotation ability. The bigger problem, however, is the fact that this kind of arrangement can be hazardous. Even if the seam construction fulfills USCG strenght requirements, the rescue attempt might fail with these kinds of sleeves: when the subject is immersed in water, the rescuer grabs the sleeve. If the armhole zipper is even a little bit open, the rescuer might end up holding only a sleeve in his hand when the zipper is open completely.

While wearing a flotation device in rainy weather or while there is water splashing around, water can seep inside the device through the shoulder seams and through sleeve longitudinal zippers. The device can become uncomfortable especially in cold conditions.

The traditional flotation jackets have a well-known common problem: they are too hot to wear causing sweating and discomfort.

Most flotation jackets have no legstraps. The ones which have them are designed in such a way that the straps hang outside the device visibly and distractively when not in use.

In special circumstances such as in Navy, Harbour Police, Coast Guard or in Marines, the safety device should also be capable to protect the wearer from bullets and fragments. This same feature could be very valuable in some recreational usage.

The traditional anti-ballistic devices are designed to press against the user's body thus being uncomfortable.

The anti-ballistic devices of today do not protect the sensitive neck area with built-in collar. The latest models have low and narrow collars leaving the front open, receptive to bullets and fragments. Some devices have attachable extra collar pieces which are not comfortable nor convenient.

SUMMARY OF THE INVENTION

My new Versatile Safety Device corrects the above-mentioned limitations. My Canadian Patented (No: 1,111,714) flotation device has been improved with this new invention in a way that it can be comfortably used:

I. In all kinds of weather conditions:

A) In cold weather. The inherent buoyancy is attained with Airex® PVC-foam, which contains millions of closed aircells and is flexible even in sub-zero (−40 F./C.) temperatures with excellent protection ability. The jacket frame, collar, sleeves, shoulder shield(s) and optionally hood, contain Airex® PVC-foam in my invention.

B) In warm weather. The sleeves have a longitudinal slit extending from the shoulder seam to the cuff in my versatile safety device. This slit is closable with zipper or any other suitable closer means including Velcro® or snaps. In warm conditions, these zippers on sleeves can be opened all the way to the armhole seams and the sleeves can be pulled inside the device where they hang flat against the sides of the user under his arms. When both sleeves are completely inside the device, it becomes a life-vest. The sleeves stay with the device at all times and even when pulled inside, are comfortable and flat. As the sleeves are provided with a layer of flotation material, the sleeves help the device in keeping the buoyancy constant. Most importantly this procedure can be done easily while the device is in use donned by the wearer. Converting the vest back to a jacket can also be done in seconds in same manner.

The other feature in this invention which is valuable in warm weather is the legstraps that go around the legs in safety-belt fashion, closable by releasable fasteners. When the weather is warm, the front zipper can be left safely open for ventilation. The legstraps hold the device with the wearer even when he is immersed. Even though the device is opened, it can not "swim" away. When not in use, the leg-straps are hidden inside the jacket under arms with the fasteners such as snaps or Velcro®.

C) In rainy weather. The construction seams on shoulders and around armholes with vacant margins in flotation material where the "breathing" occurs, said seams are covered with shoulder shield(s) which are lined with water-proof Airex® PVC-foam. The shield(s) protect(s) rain or splashing water from seeping inside the device through the vacant margins and said foam also adds buoyancy to the upper portion of the device and helps to turn the wearer to upright position when immersed. The other areas where water can seep inside the device, are the zippered outer sleeves. These zippers in my invention are covered with water repellent protector folds longitudinally.

II. This newly invented versatile safety device can also be easily converted to a bullet/fragment-proof safety device. An extra vest portion is filled with anti-ballistic inserts which inserts are made of multiple layers of anti-ballistic material such as Spectra Shield® and encased by durable fire retardant fabric. These anti-ballistic inserts are placed inside front-left/right and back pockets in the vest, said pockets being closable with any suitable closure means. The anti-ballistic inserts overlap in front leaving no space receptable for bullets/fragments. The anti-ballistic vest is easy to attach to the device with strong snaps. The attachment is designed in such a way that the flotation device holds the anti-ballistic vest from pressing against the body thus making the safety device more comfortable than most existing anti-ballistic devices. Furthermore, the anti-ballistic portion is lined with Airex® PVC-foam which acts as a buffer against the body of the wearer.

Safety Collar

The permanent collar's anti-ballistic insert which is made in same fashion with the anti-ballistic vest inserts, is fastened inside the pocket in permanent collar with Velcro® or other suitable fastener such as snaps. The anti-ballistic insert is designed in such a way that when in use, it makes the permanent collar stay in upright position. Furthermore, the collar can be tightened in front with Velcro® or snap-fasteners. When the collar is tightened in this fashion, one end of the anti-ballistic insert inside the collar-pocket slips under the other front-end of same insert and thus overlapping, protects the sensative throat area from bullets/fragments. The zipper which closes the collar-pocket for the anti-ballistic insert, is substantially shorter than the insert thus helping the anti-ballistic insert stay inside the collar-pocket. Furthermore, the anti-ballistic insert is lined sith soft PVC-foam which acts as a buffer against the neck- and throat area of the wearer.

The similarly prepared anti-ballistic portion as above, is optionally fastened to a permanent hood with snaps or other suitable fasteners. The anti-ballistic portion is lined with soft PVC-foam which acts as a buffer against the head of the wearer.

BRIEF DESCRIPTION OF THE DRAWINGS

The above-mentioned advantages can be achieved with this invention with features which are demonstrated better with the following drawings.

DETAILED DESCRIPTIONS OF A PREFERRED EMBODYMENT

Figure 1:
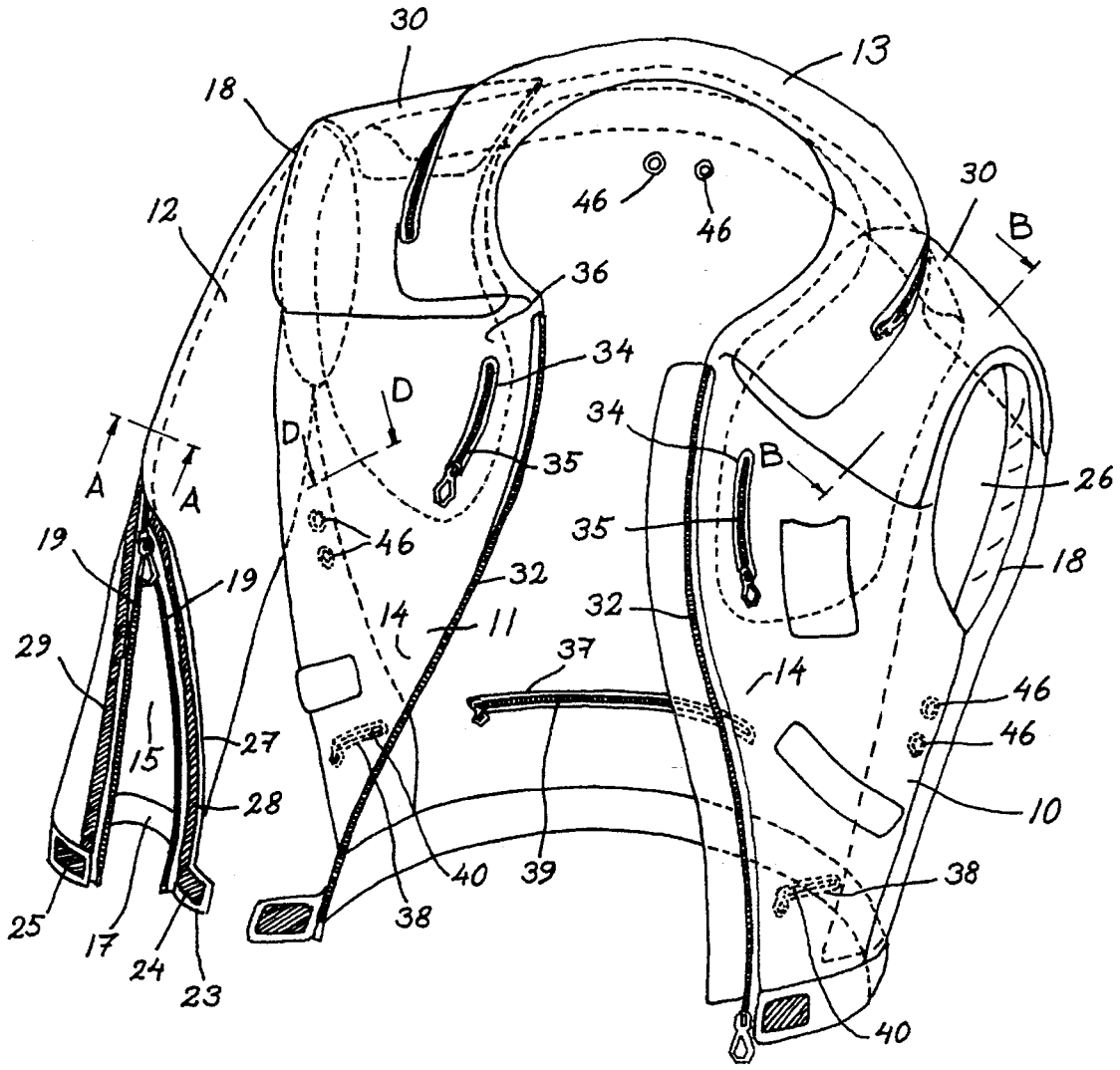
FIG. 1 shows the invented versatile safety device from the front perspective, device being opened to reveal the interior structure thereof.

Referring to FIG. 1, there is a safety device 10 with jacket frame 11, the sleeves 12, and a collar 13. The jacket frame 11, sleeves 12 and the collar 13 contain generally the outer shell 14, inner shell 15 (see also FIGS. 2,3,4,5) with flotation/buoyant material 20 inbetween. The acceptable foam materials include neoprene closed-cellular foam, vinyl closed-cellular foam and polyethylene closed-cellular foam. A particularly suitable flotation material is polyvinal chloride identified by term Airex®. As was known in the above-mentioned Canadian patent No: 1,111,714, the flotation material is always fastened along the first seams of different parts of the device with second seams which are some distance from the first seams leaving a vacant margin in between. The vacant margins are marked with number 16 in these drawings (FIGS. 2,3,4,5). This assures the flexibility in the device. From FIG. 1 one can see that the sleeves 12 have been provided with longitudinal slits starting from the cuff 17 of each sleeve and extending to the armhole 18. The slits can be closed with zippers 19 or with other suitable fasteners such as Velcro® or snaps.

Figure 2:
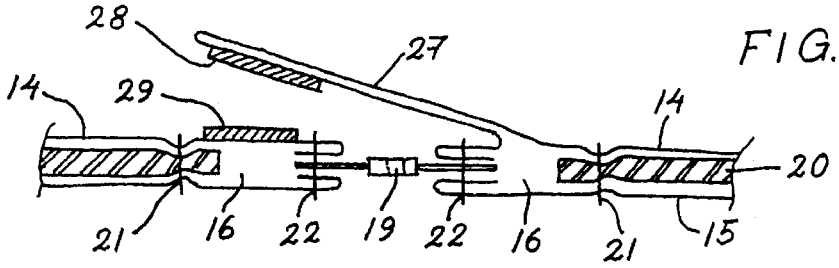
FIG. 2 is a cross-sectioned view of the device taken along line A—A of FIG. 1.

In FIG. 2 one can see how the sleeves 12 contain outer shell fabric 14 and inner shell fabric 15 with flotation material 20 in between, with first seams 22 and second seams 21 and vacant margin 16. The tightening of the cuff 17 can be achieved and regulated with Velcro® strap 24 which has been sewn on tab 23 and by using a corresponding Velcro® strap 25. When the zipper 19 is opened, one can pull the sleeve 12 entirely inside the device as is shown in FIG. 1 (right-hand side). When one pulls both sleeves 12 inside completely, one has a flotation vest which contains all the buoyancy gained with the flotation material 20 inside the sleeves 12. This can be done while the device is in use and donned by a wearer.

When the sleeves 12 are in their jacket position (FIG. 1 left) with zipper 19 closed, rain/splashing water can seep inside the device through the zipper 19 area. This can cause discomfort especially in cold weather. My invention solves this problem by providing a protector fold 27 (FIG. 2) made of water repellent fabric, above the zipper 19 area. When the zipper 19 is closed, this protector fold 27 extends and covers the whole zipper area prohibiting water from seeping inside the device. This protector fold can be fastened to the device's outer shell 14 with Velcro® 28,29 or with other suitable fastener such as snaps.

Figure 3:
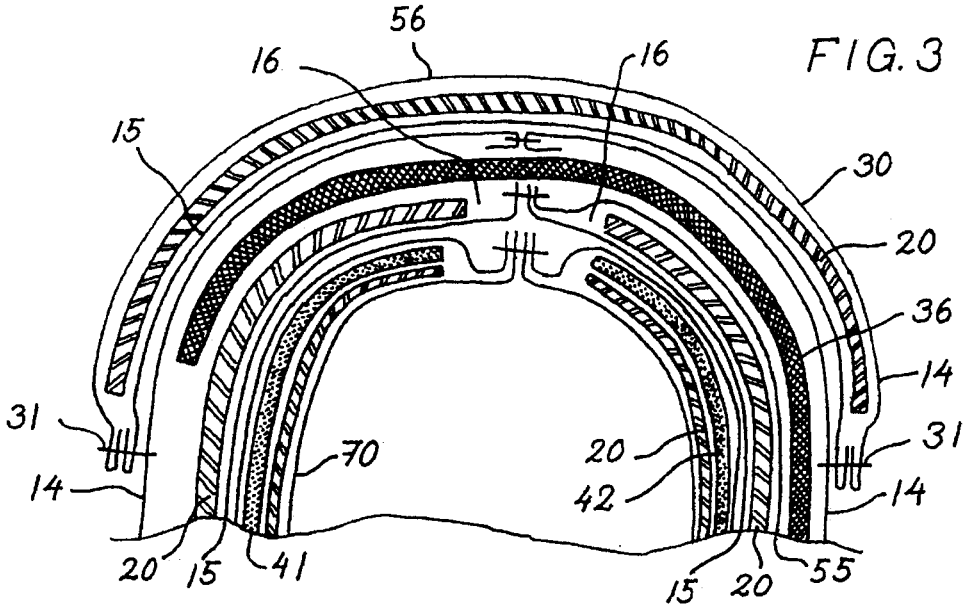
FIG. 3 is a cross-sectioned view of the device taken along line B—B of FIG. 1 and FIG. 9.
Figure 4:
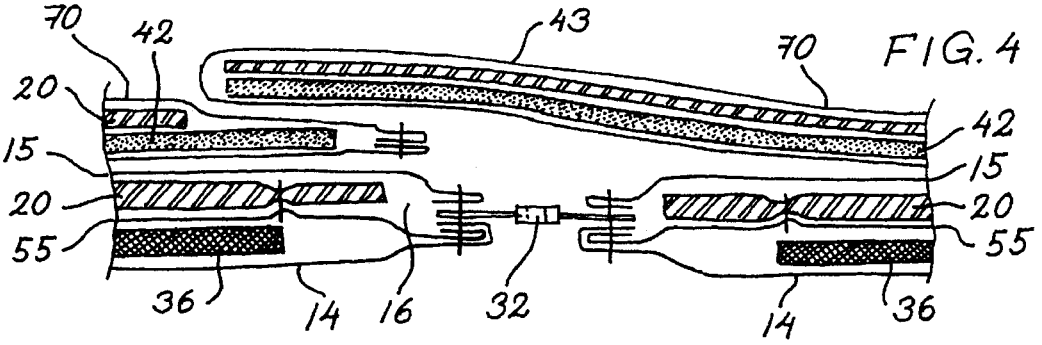
FIG. 4 is a cross-sectioned view of the device taken along line C—C of FIG. 7.
Figure 5:
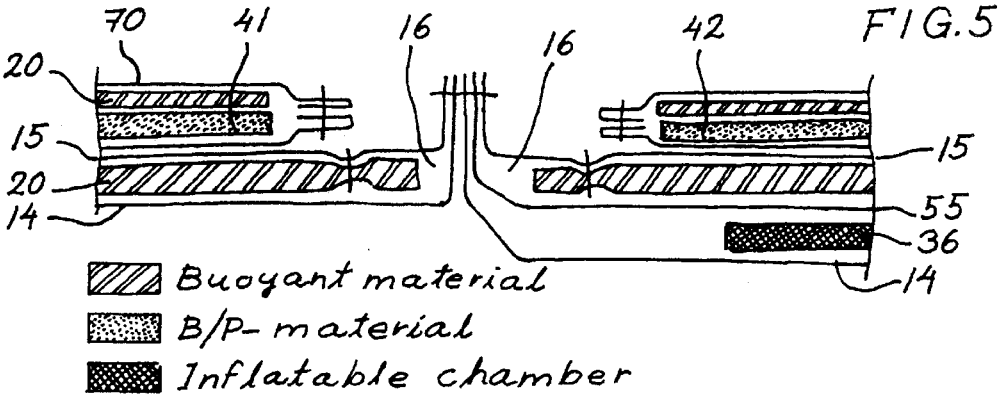
FIG. 5 is a cross-sectioned view of the device taken along line D—D of FIG. 1 and the used marking methods for different materials/parts.
Figure 9:
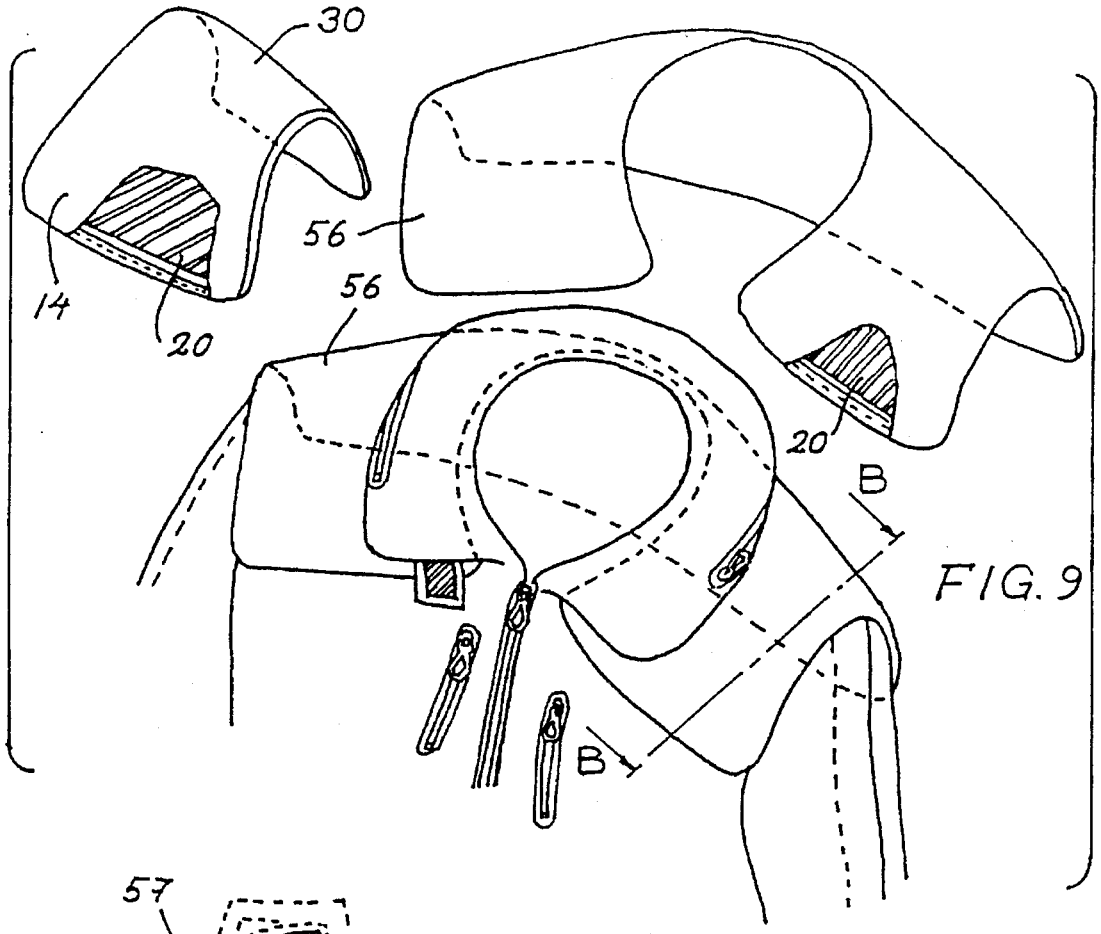
FIG. 9 represents the upper portion of the device of FIG. 1 showing the shoulder shield(s).

FIG. 3 shows the cross-sectioned view of the device 10 of FIG. 1 on the shoulder area. The jacket/vest type garments usually have shoulder seams starting form neck opening towards the upper armhole. When dealing with PFD's, these seams, especially having vacant margins 16 for breathing purposes and for flexibility, said vacant margins enable water seep inside the garment. For preventing this, my versatile safety device is provided with two special shoulder shields 30 (or one united shoulder shield 56, FIG. 9). These special shoulder shield(s) consist(s) of outer shell 14, inner shell 15 with water-proof flotation material 20 in between and are sewn in front and in back to the device 10 outer shell 14 with seams 31. In addition to preventing water from seeping inside the device, these shoulder shields 30 (or 56)

add buoyancy to the safety device because they contain flotation material 20. They are especially meaningful in turning the wearer to upright position when immersed and sometimes even being unconcious.

Figure 8:
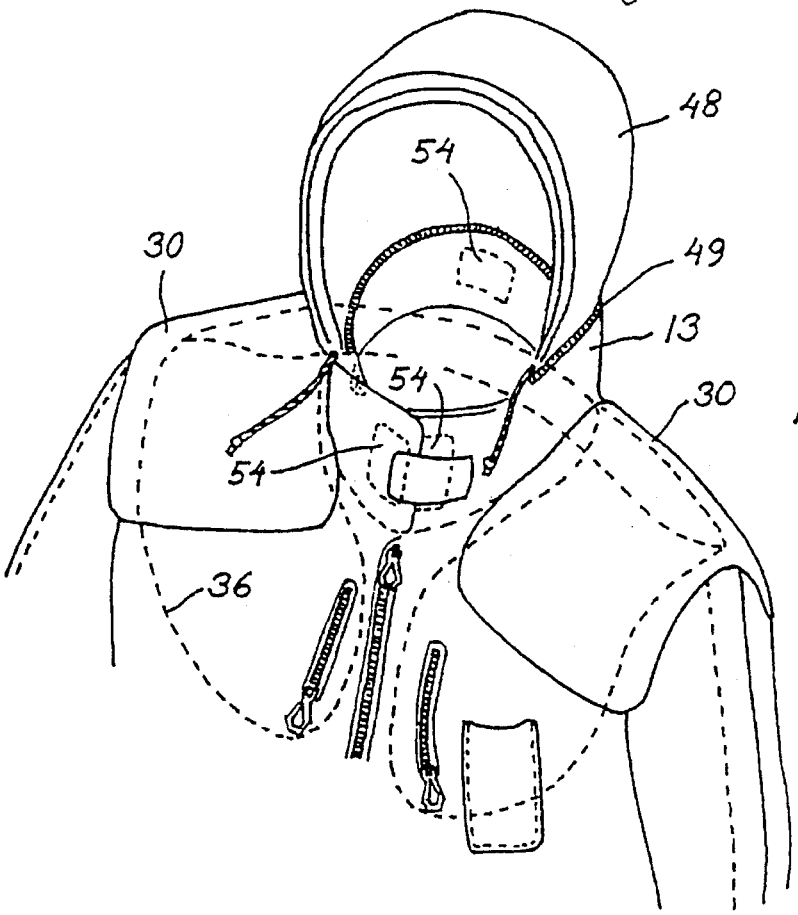
FIG. 8 represents the upper portion of the device of FIG. 1 showing the hood.
Figure 10:
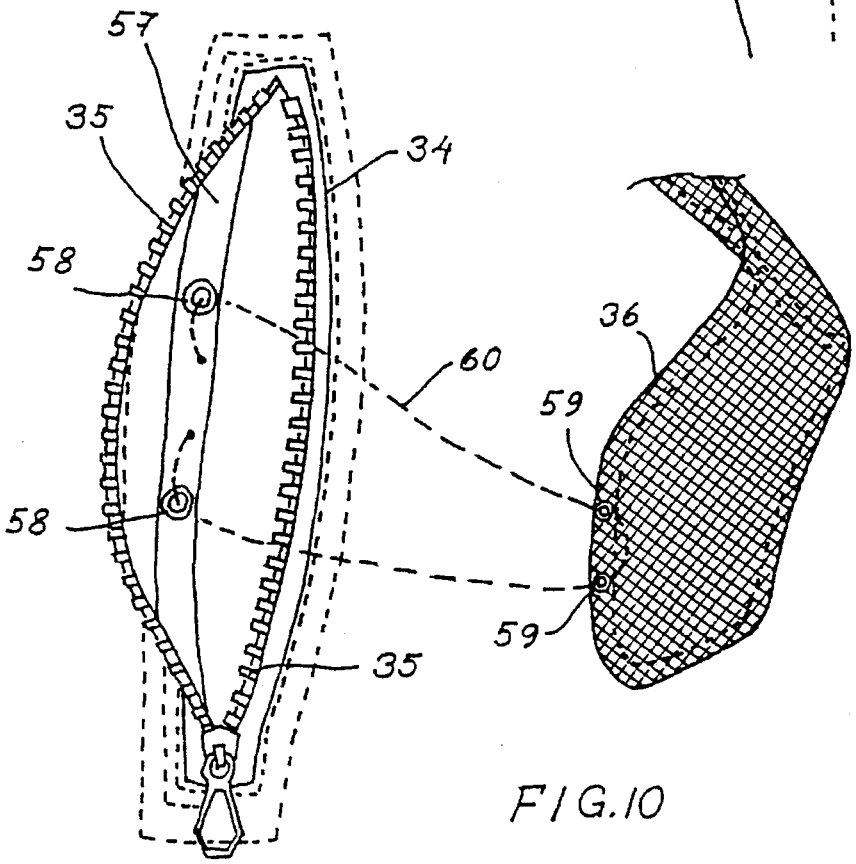
FIG. 10 represents one detail of the device of FIG. 1 according to the invention.

In both sides of my improved safety device around front zipper 32 there are openings 34 in the outer shell fabric 14 (FIGS. 1 and 10). These openings 34 are closable with zippers 35 or other suitable closure means such as Velcro® or snaps. Using these openings 34 one can place an optional inflatable chamber 36 under the outer shell 14 of the device 10. This chamber 36 can be filled automatically or manually with gas or air if more buoyancy is needed to the device 10 as in distress. As is noticeable from FIG. 1 this inflatable chamber 36 goes around the neck of the device 10 extending on both sides of front of said device. The inflatable chamber 36 does not only give more buoyancy to the device but also helps to turn the wearer to upright position when immersed. The positioning of the inflatable chamber 36 to the device 10 of FIG. 1 is illustrated with dotted lines (also FIG. 8). FIG. 10 illustrates one way of fastening the inflatable chamber 36 to the device 10 of FIG. 1. Inflatable chamber 36 is shown in FIG. 10 in smaller scale than the opening 34. Piece of webbing 57 has been sewn to both sides of the opening 34 and strenghtened holes 58 are used to fasten the inflatable chamber 36 to the webbing 57 with a cord 60. It is obvious that the fastening 58,59,60 can be achieved with other means also such as Velcro® or snaps.

Figure 6:
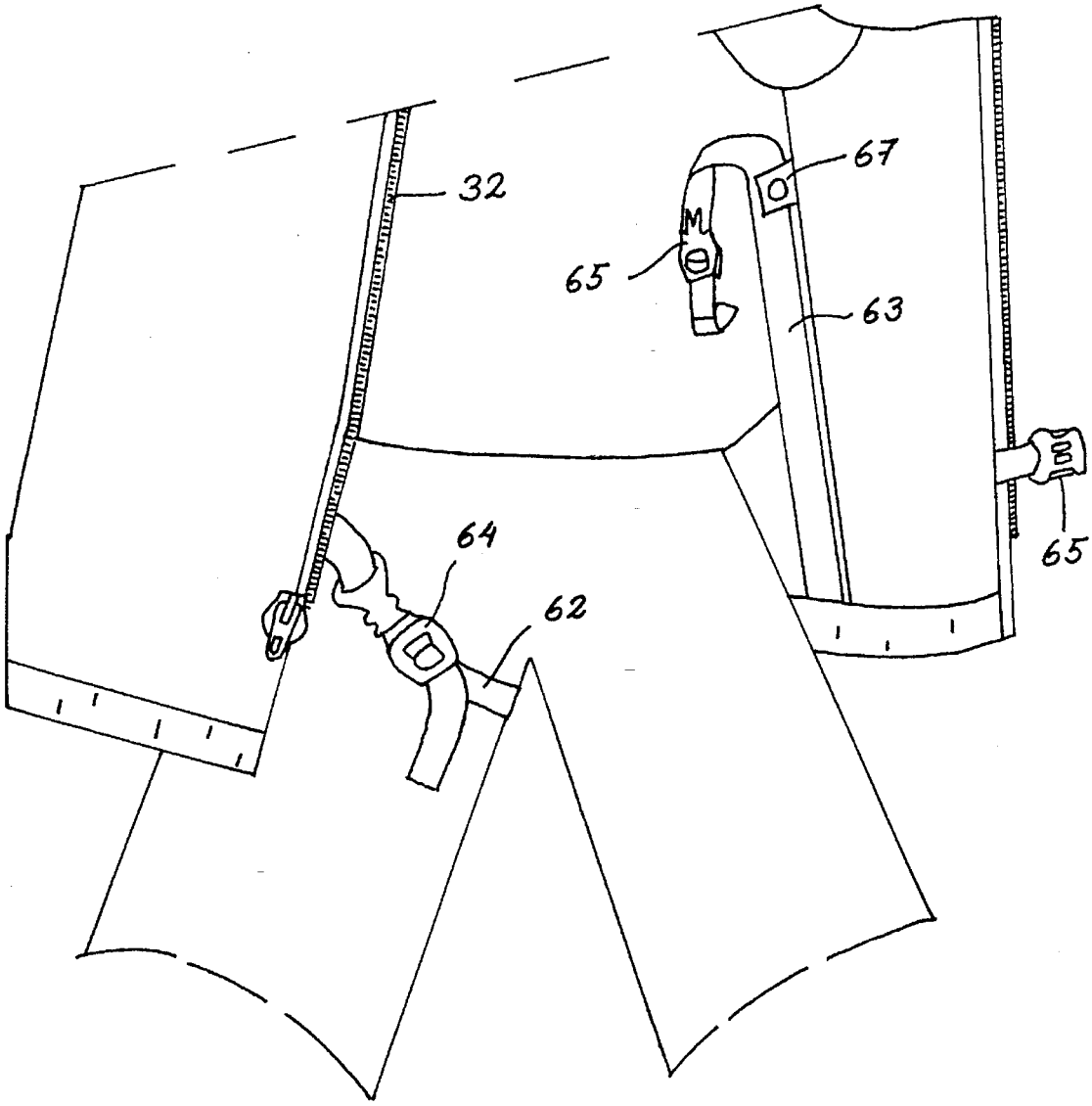
FIG. 6 shows the leg-strap assembly from partially opened front perspective of the device of FIG. 1.

This improved device is provided with leg-straps 62,63 (FIG. 6) which go around the legs of the wearer and can be tightened in front with releasable buckles 64, 65 or other suitable tightners such as O-rings. With this tightening, the front-zipper 32 can be left open safely for ventilation if weather is warm, without danger of losing the device when immersed, thus making the device comfortable to wear. When the leg-straps are not in use (FIG. 6 right side) they can be hidden inside the device by fastening the straps with snap-fastener 67 or with other suitable fastener means such as Velcro to the corresponding snap on underarm seam.

Figure 11:
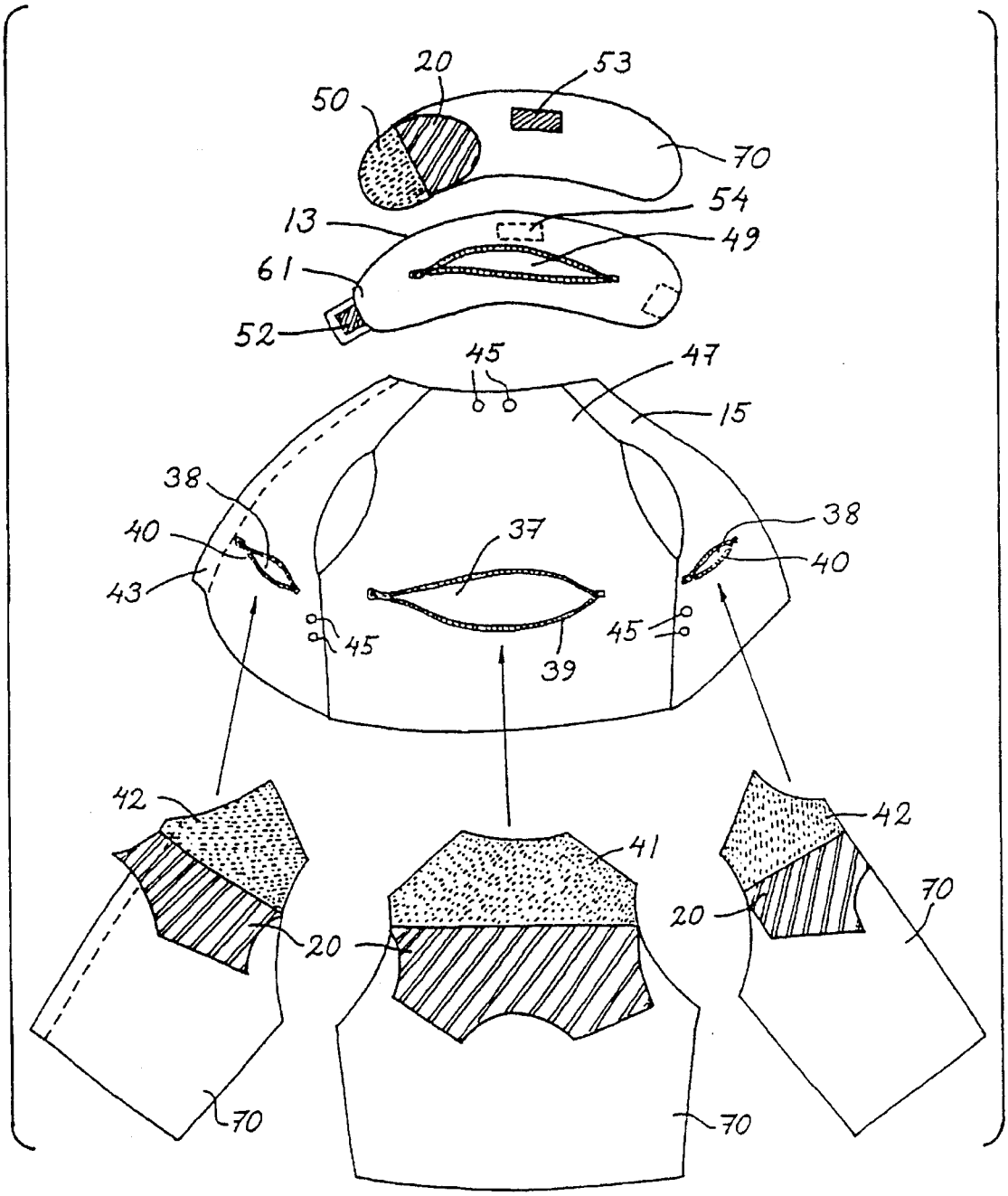
FIG. 11 represents the anti-ballistic inserts and their relations to the versatile safety device of FIG. 1.

FIG. 11 shows the separate anti-ballistic vest 47 which can be attached to the device 10 of FIG. 1 with snaps 45 and counterpart snaps 46 which are located in the device 10 in upper-back portion under collar 13 and next to side seams. The vest 47 comprises the outer shell 14 and inner shell 15 fabrics and the openings 37 and 38 in inner shell 15. Said openings 37 and 38 are closable with suitable closure means such as zippers 39, 40 (FIG. 1 and FIG. 11). Other suitable closure means are Velcro® or snaps. Through the openings 37 and 38 are inserted the anti-ballistic inserts 41 and 42 made of multiple layers of special nonhydroscopic material such as Spectra Shield® which has floating ability and said layers are encased with durable, fire retardant fabric 70 (FIGS. 3,4,5,11). In the vest 47 the front anti-ballistic inserts overlap each other 43 (FIG. 11) so that there is no vacant space left for bullets to penetrate. These inserts 41 and 42 can be easily and individually replaced if needed through closable openings 37 and 38. Thin layers of flotation material 20 (FIGS. 3,4,5,11) can be added inside the bullet/fragment-proof vest to act as a soft buffer between the device and the wearer.

Figure 7:
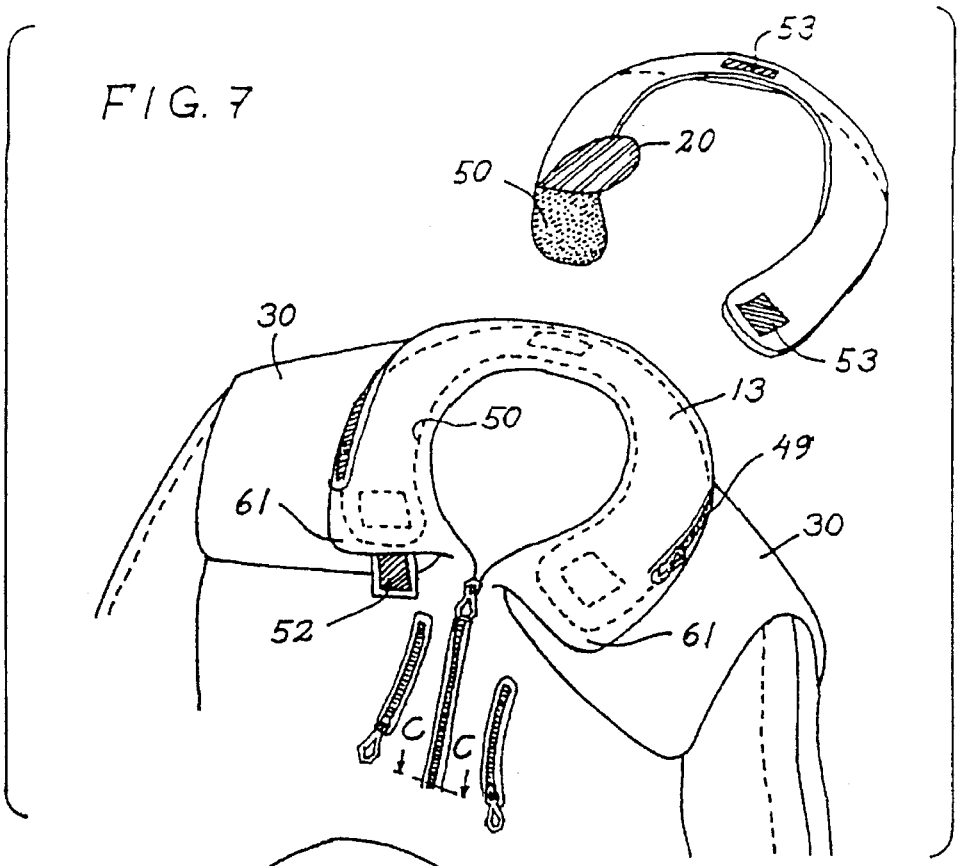
FIG. 7 shows the upper portion of the device on perspective, showing the collar's anti-ballistic insert.

The collar 13 (FIGS. 1,7,11) is principally the same as in before mentioned Canadian Patent, No: 1,111,714, comprising a hood 48 (FIG. 8) and flotation material 20. According to this invention, the anti-ballistic insert 50 (FIGS. 7,11) can be inserted easily through the zippered opening 49. This anti-ballistic insert 50 raises the collar 13 up when used. The anti-ballistic insert 50 can be fastened inside the collar 13 with Velcro® piece 53 and its counterpart 54 inside collar 13 (FIGS. 7,11). The other suitable fasteners are snaps.

The zipper 49 is shorter than the anti-ballistic insert 50 preventing the insert from escaping from the collar pocket. When the collar 13 is tightened with Velcro® 52 (FIG. 8, not seen) or other suitable closure means such as snaps, the front edges 61 (FIG. 7) of collar 13 overlap.

What is claimed is:

1. A versatile safety device comprising a jacket frame having sleeves, a collar, and shoulder shields, said device comprising in combination:

a flotation device formed by providing said jacket frame, sleeves, and shoulder shields with flotation material;

said sleeves being provided with longitudinal zippers having rain-water protectors, said jacket frame being provided with shoulder seams between the neck opening and the upper armhole protected by said shoulder shields;

said jacket frame being convertible to a flotation vest by opening the longitudinal zippers along the sleeves and pulling said sleeves inside the jacket frame leaving the upper armholes open;

said jacket frame having thermal insulation properties inherent in the flotation material, and being provided with an openable front zipper and leg straps for securing the jacket frame around the wearer's legs;

said jacket frame having construction seams being free of flotation material;

said jacket frame further including an anti-ballistic vest attached thereon and selectably inflatable chambers; and, providing the collar with an anti-ballistic insert.

2. The device of claim 1, wherein said rain-water protectors of said longitudinal zippers are provided with fasteners between said rain-water protectors and sleeves.

3. The device of claim 1, wherein said anti-ballistic vest is attached to said device in upper back portion and next to side seams, thereof, otherwise being loose.

4. The device of claim 1, wherein said anti-ballistic vest is attached to said device with snaps.

5. The device of claim 1, wherein said anti-ballistic insert is fastened inside said collar with hook and loop type fasteners.

6. The device of claim 1 or 5, wherein said anti-ballistic insert in said collar makes said collar stay in upright position protecting the neck-, cheek-, and ear-areas.

7. The device of claim 6, wherein said anti-ballistic insert has overlapping front-edges.

8. The device of claim 1, further comprising a permanent hood and an anti-ballistic portion attachable with snaps outside said hood.

9. The device of claim 1 or 8, wherein said anti-ballistic vest, insert, and portion are lined with soft buffer.

* * * * *